US009739079B1

(12) United States Patent
Guenschel

(10) Patent No.: US 9,739,079 B1
(45) Date of Patent: Aug. 22, 2017

(54) HIDDEN HINGE FOR A DISPLAY CASE

(71) Applicant: Helmut Guenschel, Catonsville, MD (US)

(72) Inventor: Helmut Guenschel, Catonsville, MD (US)

( * ) Notice: Subject to any disclaimer, the term of this patent is extended or adjusted under 35 U.S.C. 154(b) by 0 days.

(21) Appl. No.: 15/337,083

(22) Filed: Oct. 28, 2016

(51) Int. Cl.
*E05D 11/10* (2006.01)
*E05D 3/14* (2006.01)
*E05D 7/00* (2006.01)

(52) U.S. Cl.
CPC ..... *E05D 11/1021* (2013.01); *E05D 3/14* (2013.01); *E05D 7/00* (2013.01); *E05Y 2900/202* (2013.01)

(58) Field of Classification Search
CPC ..... Y10T 16/547; Y10T 16/5476; Y10T 16/5478; Y10T 16/551; Y10T 16/558; Y10T 16/5595; Y10T 16/55963; E05D 11/1021; E05D 3/14; E05D 3/06; E05D 3/142; E05D 7/00; E05D 11/06; E05D 15/28; E05D 15/30; E05F 5/006; E05Y 2900/20
See application file for complete search history.

(56) References Cited

U.S. PATENT DOCUMENTS 1,412,107 A 4/1922 Evans
1,817,773 A 8/1931 Sipe
2,008,256 A 7/1935 Lefevre
2,062,840 A 12/1936 Soss
2,355,542 A 8/1944 Loftin
2,674,761 A 4/1954 Weiss
2,771,042 A 11/1956 Deaton
2,954,578 A * 10/1960 Nyquist ..... E05D 3/18 16/361
3,425,766 A * 2/1969 Crisera ..... E05D 3/14 16/370
3,523,323 A 8/1970 Jorgensen
4,135,273 A 1/1979 Holmes
4,157,599 A 6/1979 Holmes
4,729,616 A * 3/1988 Vogt ..... A47B 88/48 220/23.4
4,848,244 A 7/1989 Bennett
5,497,534 A 3/1996 Caruso
5,544,595 A * 8/1996 Stephenson, III .. E05D 11/0018 109/73
5,704,095 A 1/1998 Guenschel
6,402,270 B1 * 6/2002 Frank ..... A47F 3/005 16/366

(Continued)

*Primary Examiner* — Chuck Mah
(74) *Attorney, Agent, or Firm* — Larry J. Guffey

(57) ABSTRACT

A hidden, corner hinge assembly for a display case includes: (a) a fixed, inner rail with an interior space with an opening, (b) a movable, door rail with a semi-enclosed, interior space with a opening that is adapted to allow the adjoining fixed, inner rail to pass into and out of this opening when the display case's door moves between closed and open positions, (c) inner rail posts mounted within the semi-enclosed, interior spaces, (d) a first and a second link, each with an end that rotatably attaches to a rail post in each of the semi-enclosed, interior spaces, and (e) wherein the locations of the post mountings and the configurations and lengths of the link are set so as to allow the display case's door to open by moving inward and away from the vertical edge where the hinge assembly is being used.

12 Claims, 6 Drawing Sheets

(56) References Cited

U.S. PATENT DOCUMENTS

| | | | | |
|---|---|---|---|---|
| 7,197,790 | B1 * | 4/2007 | Edmondson | E05D 3/16 16/286 |
| 7,698,785 | B2 * | 4/2010 | Bennett | E05D 3/16 16/239 |
| 8,226,183 | B2 * | 7/2012 | Kang | E05D 3/022 16/362 |
| 2009/0045646 | A1 * | 2/2009 | Clare | E05D 3/16 296/37.6 |
| 2012/0260461 | A1 * | 10/2012 | Lautenschlager | E05D 3/14 16/352 |
| 2013/0212835 | A1 * | 8/2013 | Lanzani | E05D 3/14 16/287 |
| 2014/0215761 | A1 * | 8/2014 | Zetti | E05D 3/16 16/288 |
| 2015/0167366 | A1 * | 6/2015 | Armstrong | E05D 3/142 16/370 |

* cited by examiner

HIDDEN HINGE FOR A DISPLAY CASE

BACKGROUND OF THE INVENTION

1. Field of the Invention

The present invention relates generally to hinge hardware that have plural axes. More particularly, the present invention relates to a corner hinge assembly for use on a display case that has a heavy door (such as a thick glass door typically used on a museum display case) which opens outwardly around one of the door's vertical edges and wherein the configuration of the corner hinge assembly is such that it hidden from view within the specialized supporting structure for the display case.

2. Description of the Related Art

A heavy door or door panel, such as the thick glass door found on museum display cases or cabinets, requires a strong hinge on the vertical edge of the cabinet about which the door is to swing or move to provide support for the door or panel as it is moved between an opened and a closed position. It would also be beneficial if this hinge could be designed so that it would not require the opening door to move outside of or to the side of the cabinet's vertical edge about which the door is to move as such a hinge would enable the door to be fully opened even in the situation where there is a vertical wall that adjoins the cabinet on this vertical edge. Additionally, there are other situations, in which for security or visual aesthetic purposes, it would be beneficial to also have such a hinge be configured such that it is concealed and not readily accessible.

U.S. Pat. No. 1,412,107 to Evans, Jr. discloses a garage door hinge having arms equidistant from the center and side edge of the door. U.S. Pat. No. 1,817,773 to Sipe discloses a concealed door hinge having a dual pair of pivots with connecting links. During the opening of the door, the hinged side travels behind the face line of the mounting surface on the cabinet.

Lefevre, in U.S. Pat. No. 2,008,256 discloses a concealed door hinge for an automobile which does not permit the hinge to be mounted between the door and the structure. One part of the hinge is mounted on the edge of the door and the other part is mounted on the doorjamb which must be adjacent to the edge of the door in the closed position. The links are relatively lightweight and direct the throwout or offset of the door while not carrying a substantial part of the load.

U.S. Pat. No. 2,771,042 to Deaton discloses a hinge for bank vault doors in which the main hinge plate carries the entire weight of the door and the link stabilizes the door. The door moves between the closed and opened positions by maintaining the door parallel to the closed position without rotation of the door. U.S. Pat. No. 4,135,273 to Holmes discloses a hinge with interfitting locking means in which the door rotates about a single pivot point.

U.S. Pat. No. 4,848,244 to Bennett discloses a pair of fold-away hinges to support a horizontal work surface which can be folded down when not in use. A slot is provided in which one of the pivots slides during raising and lowering of the work surface. U.S. Pat. No. 5,704,095 to Guenschel discloses a hinge which permits pivotal movement of the door or panel in a manner such that the door moves, as it opens, towards the center of the front of the display case and therefore it does not come into contact with a wall that directly abuts the vertical edge of the display case about which the door is opening. This hinge has the same inventor as the present invention and the information in U.S. Pat. No. 5,704,095 is included herein by reference and its disclosed hinge is referred to herein as a "Vista" hinge.

Despite this prior art, there is a need for an improved hinge assembly for use on display cases having glass top panels and which utilize heavy doors when it is desired to place the vertical edge about which the case's door is to open tight against an adjoining vertical wall and, while at the same time, for security and visual aesthetic reasons, concealing the hinge so that it cannot be seen by one who examines the exterior surface of the display case.

SUMMARY OF THE INVENTION

A hidden, corner hinge assembly for a display case includes: (a) fixed, inner rail with a FIR centerline and a FIR semi-enclosed, interior space with an opening to the environment surrounding the display case, (b) a movable, door rail with a MDR semi-enclosed, interior space with a MDR opening that is adapted to allow a significant portion of the adjoining fixed, inner rail to pass into and out of the MDR opening when the display case's door moves between closed and open positions, (c) inner rail posts mounted within the FIR and MDR semi-enclosed, interior spaces, (d) a first and a second link, each with an end that rotatably attaches to a rail post in each of the semi-enclosed, interior spaces, and (e) wherein the locations of the post mountings and the boundary configurations and lengths of the link are set so as to allow the display case's door to open by moving inward and away from the vertical edge of display case where the hinge assembly is being used until the FIR and MDR centerlines have attained a desired intersection angle.

Thus, there has been summarized above (rather broadly and understanding that there are other preferred embodiments which have not been summarized above) the present invention in order that the detailed description that follows may be better understood and appreciated.

DESCRIPTION OF THE PREFERRED EMBODIMENT

Figure 1:
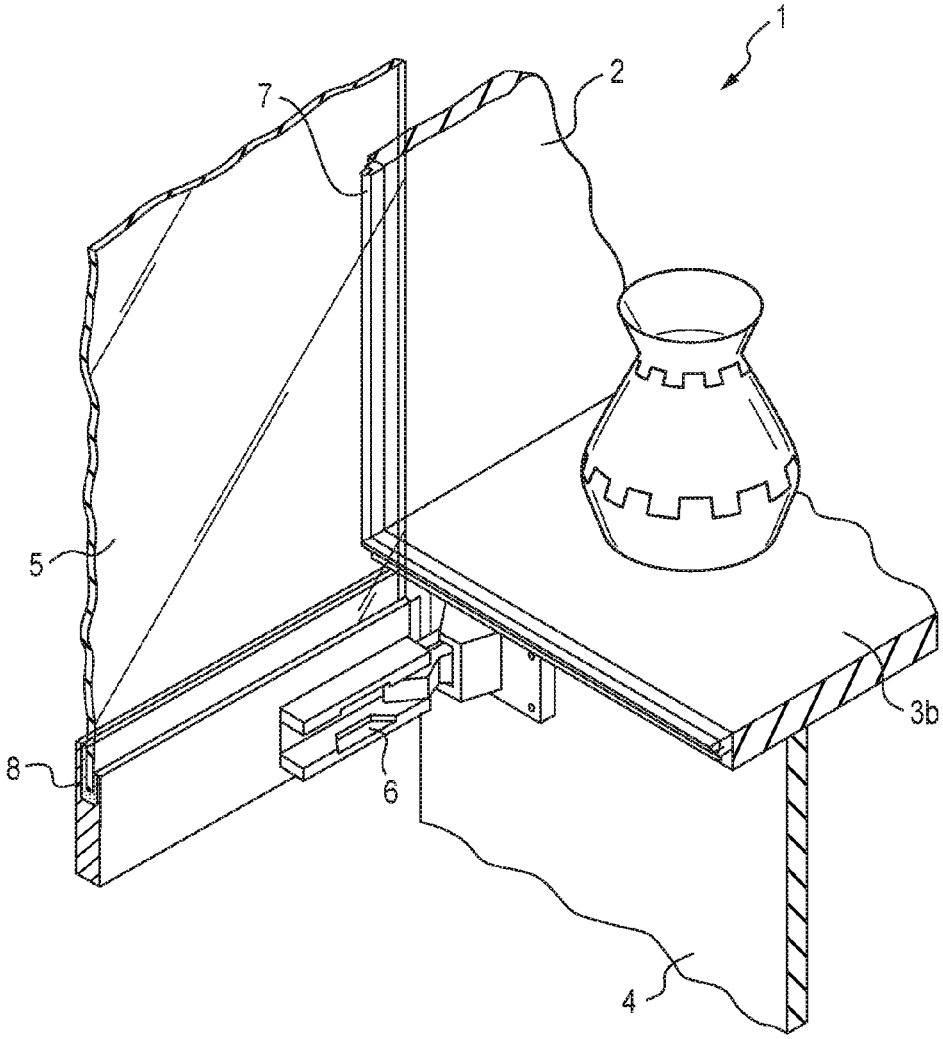
FIG. 1 (PRIOR ART)
FIG. 1 is a partial, perspective view of a corner of a prior art display case that has its door panel fully open; this display case is a candidate to be upgraded so as to make use of the hidden, corner hinge assembly of the present invention.

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Shown in FIG. 1 is a corner view of a museum quality, glass display case with a front door panel 5, which utilizes a bottom (prior art, U.S. Pat. No. 5,704,095 "Vista") hinge 6, that has been moved inward (i.e., toward the display case's centerline so that the door panel in its movement does not come into contact with a wall that adjoins the display case on the side where the hinges are located) and away from the vertical edge 7 of the display case box unit 8 to which the door panel attaches so as to provide access to the unit's interior space.

When it is desired that such a display case have a top panel that is glass, the hinge shown in FIG. 1 cannot be used on the top of the door panel since there is no place to mount it. This situation led to the present invitation which can be used as a hidden, top corner hinge assembly in such applications.

The display case shown in FIG. 1 has transparent sides 2, and top 3*a* and bottom 3*b* panels that are supported and held in place by a supporting structure 4 that usually consist of horizontally oriented, top and bottom rails and no vertical, structural members so as to maximize the visibility into the display case. To gain access into the interior region of such a display case, one of its side panels will generally serve as a door and will thus be designated herein as the display case's door panel 5. Hinges are mounted at the top and bottom of the proximal 7 vertical edge about which the door panel rotates to enable the door panel to be moved towards the center of the front of the display case and away from any wall that might abut the vertical edge of the display case about which its door panel is opening.

For the purpose of discussing the present invention, it proves useful to define the portion of the top, horizontal portion of the supporting structure that adjoin this door panel's top edge and is proximate the vertical edge about which the door panel rotates as the top "fixed inner rail (FIR)" that is especially adapted and configured to be part of the present invention's hidden, corner hinge assembly.

Figure 2:
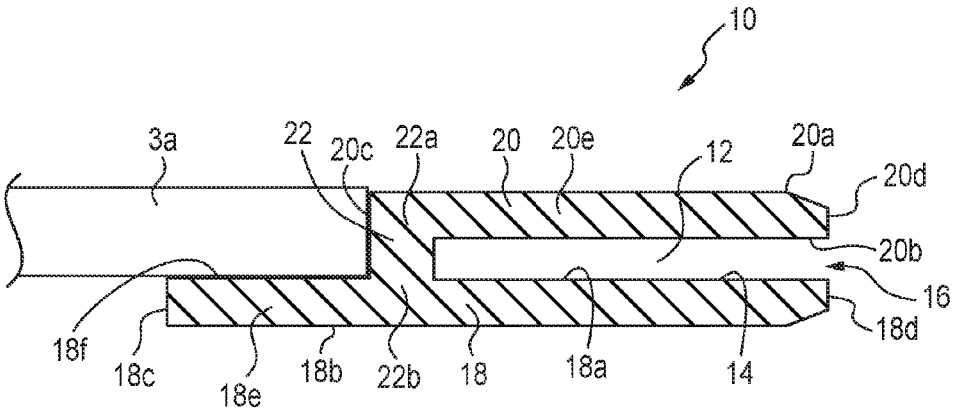
FIG. 2 is a cross-sectional view of the present invention's specialized fixed, inner rail that is used in that portion of the door panel's top or bottom edge that is proximate the vertical edge about which the door is hinged.

FIG. 2 shows a cross sectional view of the present invention's specialized fixed, inner rail that is used across a portion of the length of the supporting structure's top edge and is attached proximate the vertical edge about which the door panel rotates. This top fixed, inner rail 10 has a proximal end 10*a* that adjoins this vertical edge and a distal end 10*b* (see FIG. 6) which is located a short distance away (i.e., only a fraction of the distance across the supporting structure's top edge and with this distance being defined as the length of the fixed, inner rail) and between which extends a fixed inner rail (FIR) centerline 11. This fixed, inner rail 10 has been configured so that it generally provides an FIR semi-enclosed, interior space 12 with a FIR boundary surface 14 and an FIR opening 16 that is directed outwardly towards the environment that surrounds the display case. It should be noted that this piece and those shown in FIG. 3 and FIG. 4A-4B have been drawn approximately to scale and assuming that the typical thickness of the glass which is to be used in the door where this hinge assembly will be used is shown by the distance between the movable door rail's outer 42 and inner 44 side door members.

In a preferred embodiment, this fixed, inner rail 10 is seen to include lower 18 inner and upper 20 inner members that are spaced apart by a vertical spacer 22 that connects them and aligns them so that they are parallel to each other and spaced apart a uniform inner, gap distance. This lower, inner member has lower, inner member (LIM) top 18*a* and LIM bottom 18*b* surfaces that are flat, LIM interior 18*c* and LIM exterior 18*d* edges that are parallel to each other, and LIM proximal 18*e* and LIM distal ends and wherein this LIM proximal end is assumed to be located proximate the vertical edge about which the door panel swings.

Meanwhile the upper inner member 20 has upper inner member (UIM) top 20*a* and UIM bottom 20*b* surfaces that are flat and parallel to each other, UIM interior 20*c* and UIM exterior 20*d* edges that are parallel to each other and wherein the distance between these edges defines the UIM width of this upper inner member. It also has UIM proximal 20*e* and UIM distal ends and wherein its UIM proximal end is located proximate the vertical edge about which the door panel moves.

The top, fixed, inner rail's vertical spacer 22 has top 22*a* and bottom 22*b* ends that are parallel to each other and spaced apart a distance that is equal to the rail's uniform inner, gap distance, with the bottom end of the vertical spacer connecting to the LIM top 18*a* surface at a uniform distance from the LIM exterior 18*d* edge that is equivalent to the UIM width of the upper 20 inner member, and with the top 22*a* end of the vertical spacer connecting to the UIM bottom 20*b* surface at the interior 20*c* edge of the upper inner member. The portion of the LIM top 18*a* surface that is interior to the location where the vertical spacer's bottom end is attached to the lower inner member's LIM top surface 18*a* forms a ledge or support 18*f* on which a top panel 3*a* may rest.

Additionally, the proximal ends of the upper and lower inner members are shortened and configured so as to provide the members with an inner member (IM) locking portion 24 (see FIG. 5) that is located at a prescribed distance from the proximal ends of the upper and lower inner members. This IM locking portion 24 has a boundary surface that is perpendicular to the exterior edges of the upper and lower inner members and these member's proximal ends are further configured to have inner rail cutout portions 26 that provide for the ability of the door to move outward from a closed position in which the exterior ends of the upper and lower inner members are adjacent and parallel to the outer, side door member (OSM) interior surface and to an open position in which the door has rotated outward so that the MDR centerline becomes approximately perpendicular to the FIR centerline and with the IM locking portion of each of the upper and lower inner members being used to fix the door in its most open position.

Figure 3:
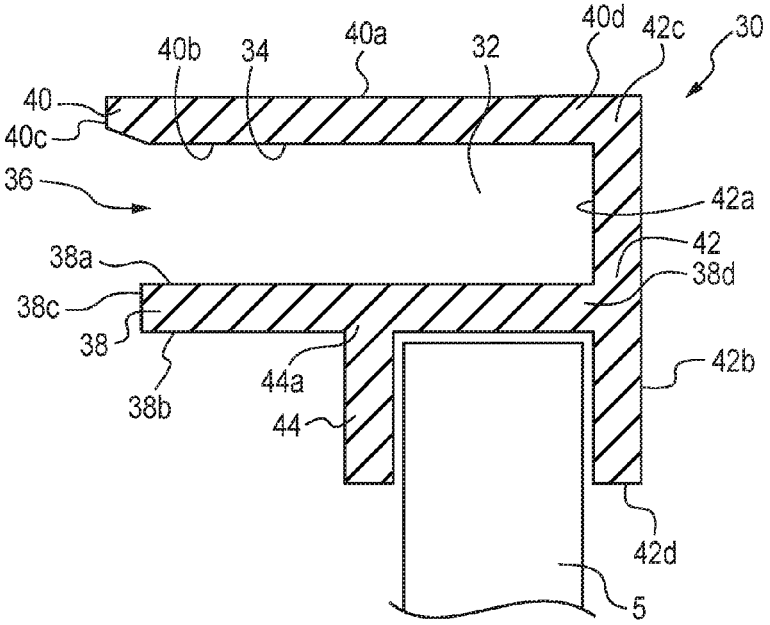
FIG. 3 is a cross-sectional view of the present invention's specialized movable, door rail that connects to a door panel across its top or bottom edge.

FIG. 3 shows an end or cross sectional view of the present invention's specialized movable, door rail that connects to the door panels across its top edge. This top movable, door rail 30 has ends between which extend a movable, door rail (MDR) centerline 31 and it has been configured so that it generally provides an MDR semi-enclosed, interior space 32 with a MDR boundary surface 34 and an MDR opening 36 that, when the door panel is closed, is directed towards the door panel's fixed inner rail to allow a significant portion of the fixed, inner rail to pass into and out of the MDR opening 36 when the door panel moves between a closed and an open position.

In a preferred embodiment, this movable, door rail 30 includes lower 38 and upper 40 door members and an outer side 42 door member. This lower door member has a lower door member (LDM) top 38*a* and LDM bottom 38*b* surfaces that are flat and parallel to each other, LDM interior 38*c* and LDM exterior 38*d* edges that parallel to each other and wherein the distance between these edges defines the LDM width of the lower door member. This lower door member also has LDM proximal 38*e* and LDM distal ends and wherein the LDM proximal end is located proximate the vertical edge about which the door panel moves.

The upper door member is seen to have an upper door member (UDM) top 40*a* and UDM bottom 40*b* surfaces that are flat and parallel to each other, UDM interior 40*c* and UDM exterior 40*d* edges that are parallel to each other and wherein the distance between these edges defines the width of the upper door member, and UDM proximal 40*e* and UDM distal ends and wherein the UDM proximal end is located proximate the vertical edge about which the door panel moves.

The outer, side door member has OSM interior 42*a* and OSM exterior 42*b* surfaces that are flat and parallel to each other, OSM joining 42*c* and OSM free 42*d* edges that parallel to each other, and the outer, and OSM proximal 42*e* and OSM distal ends and wherein the OSM proximal end is located proximate and closer to the vertical edge about which the door panel moves than the proximal end of the upper and lower door members so as to provide the outer side door member with an OSM locking portion 42*f* that extends beyond the proximal ends of the upper and lower door members.

This movable, door rail 30 is arranged so that the UDM exterior edge 40*d* is attached to the OSM joining edge 42*c* so that the upper door member is perpendicular to the outer side door member. Meanwhile, the LDM exterior edge 38*d* is attached to the OSM interior surface 42*a* so that the upper and lower door members are parallel to each other and spaced apart to form a door gap in which the spaced apart distance of the door gap is set so as to allow the spaced apart, lower 18 and upper 20 inner members of the inner rail to fit within these parallel and spaced apart, upper and lower door members of the door rail.

Additionally, the movable door rail has an inner side 44 door member with a proximal end 44*a* that is attached perpendicularly to the lower door member's bottom surface 38*b* at a distance from the outer door member's interior 42*a* surface so that it can cooperate with the outer door member to form an enclosing member around the top edge of the door panel to lock it in place within the movable door rail.

As a further part of a preferred embodiment of the present invention, a first 50 and second 52 inner rail post are mounted within the FIR semi-enclosed, interior space, and a first 54 and second 56 door rail post are mounted within the MDR semi-enclosed, interior space.

Figure 4A:
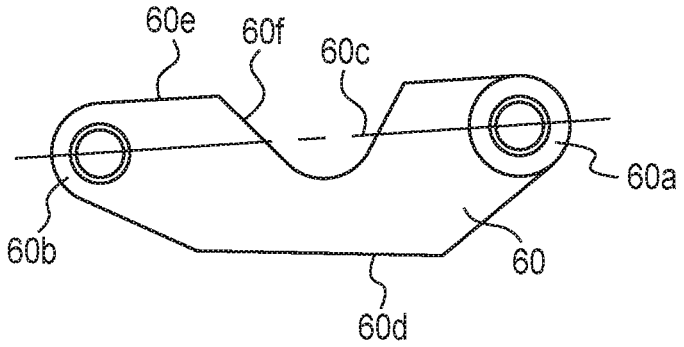
FIGS. 4A and 4B are, respectively, top views of the present invention's specialized first and second links that connect between its member's posts.
Figure 4B:
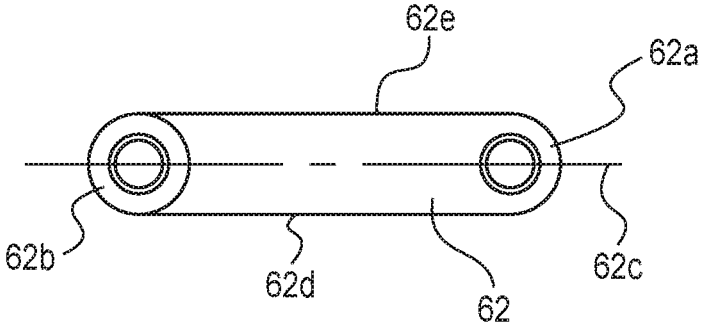

FIGS. 4A and 4B show respectively top views of the present invention's specialized first 60 and second 62 links that connect between the member's posts. This first link is seen to have proximal 60*a* and distal 60*b* ends, a FL centerline 60*c* therebetween, and wherein the distance between the ends defines the link's FL length, and FL inner 60*d* and FL outer 60*e* edges, wherein this proximal end is rotatably attached to the first 50 inner rail post and the distal end is rotatably attached to the first 54 door rail post. The FL outer 60*e* edge is seen to be configured with a link cutout portion or notch or scalloped boundary edge 60*f* which we'll later see in FIG. 5D is used to effectively control the maximum movement of the door panel when it is opened. Meanwhile, the second link is seen to have proximal 62*a* and distal 62*b* ends and a SL centerline 62*c* therebetween, and wherein the distance between the ends defines the second link's SL length, and SL inner 62*d* and SL 62*e* outer edges, wherein its proximal end is rotatably attached to the second 56 door rail post and its distal end is rotatably attached to second 52 inner rail post.

Figure 5A:
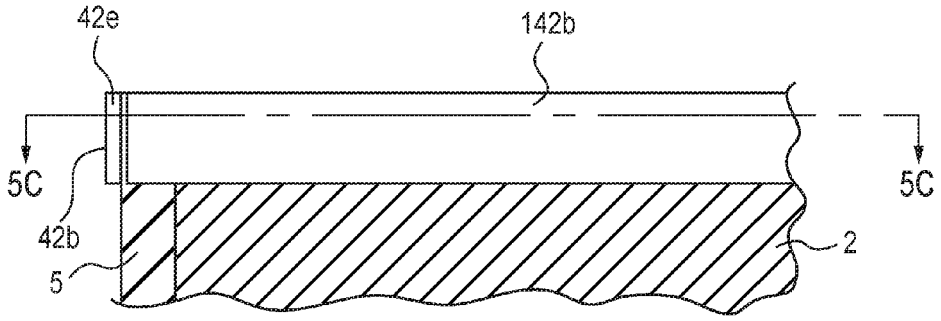
FIGS. 5A, 5B and 5C are, respectively, partial, side, top and cross-sectional views of a top corner hinge assembly of the present invention when the display case's door panel is in its closed position.
Figure 5B:
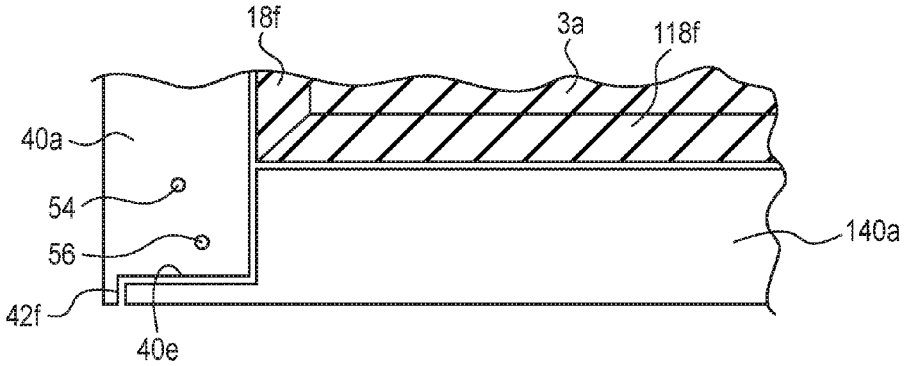
Figure 5C:
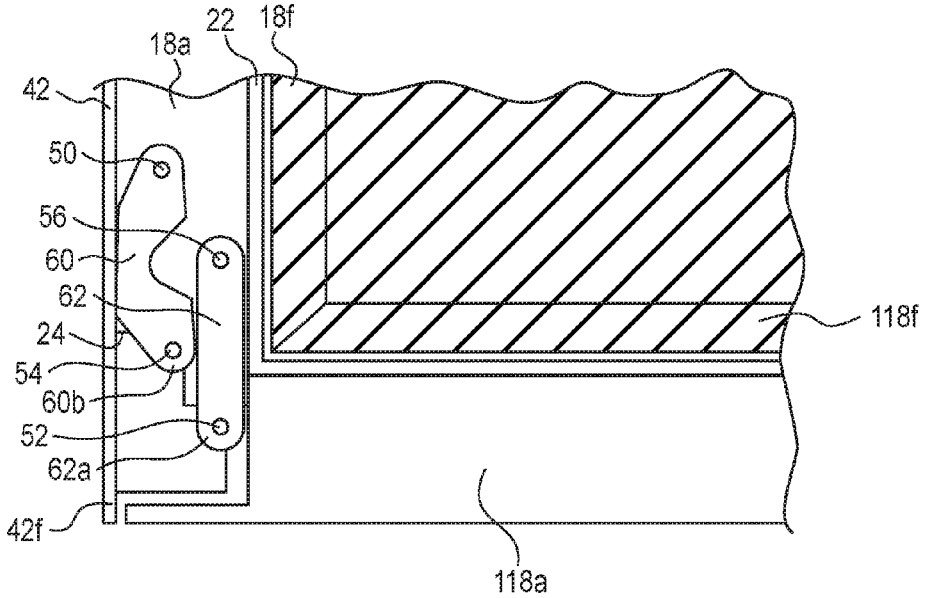
Figure 5D:
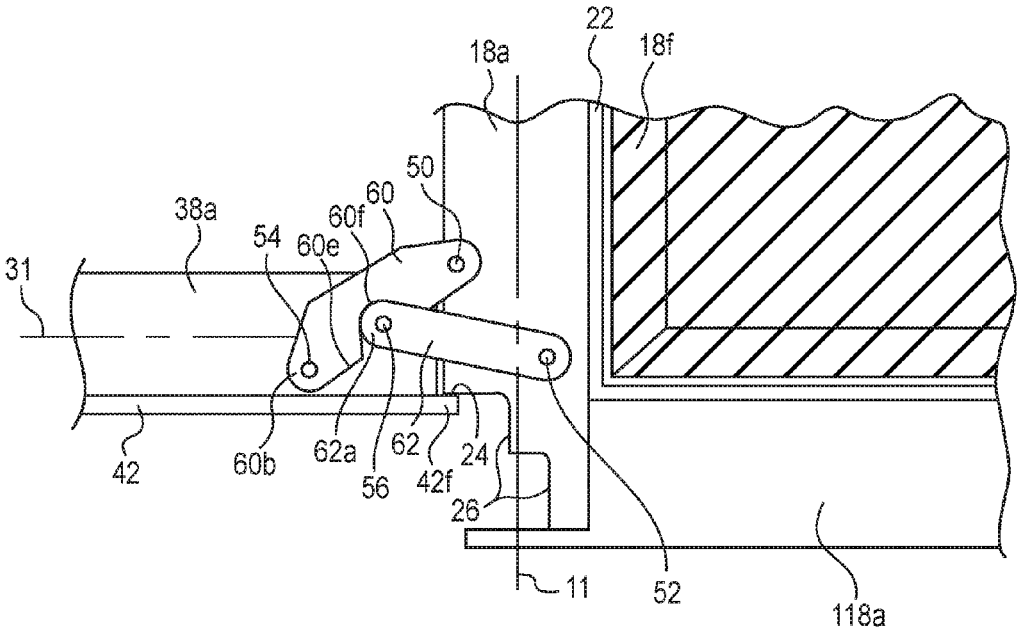
FIG. 5D is a cross-sectional view of the corner hinge assembly of the present invention, taken on the same viewing plane as that of FIG. 5C, when the display case's door panel has been moved to its fully open position.

FIGS. 5A, 5B and 5C show, respective, partial, side, top and cross-sectional views of a top corner hinge assembly when the door panel is in its closed position. The plane of the cross-sectional view is located so as to look downward from within the fixed, inner rail's FIR semi-enclosed, interior space 12 so as to see the hinge assembly's links 60, 62.

Also seen is these figures is a side panel 2. In this embodiment, the supporting structure for the side panel is made from the same fixed, inner rail and door rail components as its door panel, but with these components locked together. Thus, in FIGS. 5A, 5B and 5C there can be seen, respectively, an OSM exterior 142*b* surface, an UDM top 40*a* surface and a LIM top 118*a* surface. FIG. 5A shows that the supporting structure for the top edges of the display case's panels appears as a band or rail of material that wraps around the panel's top edges.

FIG. 5B shows the upper door member's UDM top 40*a* surface and how its proximal end 40*e* is configured to provide the outer side door member with an OSM locking portion 42*f* that extends beyond the proximal ends of the upper and lower door members. Also seen are the mounting pins of the first 54 and second 56 door rail post that are mounted within the MDR semi-enclosed, interior space.

FIG. 5C shows the links 60, 62 that are mounted in the fixed, inner rail's FIR semi-enclosed, interior space 12. It also partially shows how the proximal end of the inner rail is configured with cut-outs 26 that are necessary to allow the movable door rail's first 54 and second 56 door rail posts and their attached links to move from the door panel's closed position as the door panel moves outward in translational and rotation motion through space that would otherwise been, but for the cut-outs, part of the MDR semi-enclosed, interior space.

FIG. 5D is a cross-sectional view of this top corner hinge assembly, taken on the same viewing plane as that of FIG. 5C, when the door panel has been moved to its fully open position. It can be seen that during the door panel's opening both of the links 60, 62 have moved, from positions wherein their centerlines were, as shown in FIG. 5C when the door panel was closed, essentially parallel to one another, to new positions in which their centerlines now intersect. The second link's proximal 62*a* end has rotated clockwise around its distal end that is attached to the second 52 inner rail post. Meanwhile, the first link's distal 60*b* end has also rotated clockwise around its proximal end 60*a* that is attached to the first 50 inner rail post. The motion of these links stops in part when the second link's proximal 62*a* end lodges itself in the first link's cutout or notch portion 60*f* when the centerline 31 of the movable door rail has achieved a desired intersection angle with the centerline 11 of the fixed inner rail. This intersection angle has been set to approximately 90 degrees for the example or embodiment shown in FIG. 5D. In this situation, stopping of the door panel's opening motion is also aided by the outer side door member's OSM locking portion 42*f* coming to rest against the FIR locking portion 24 of each of the upper and lower inner members.

Thus, to provide for the necessary movement of the proximal, vertical edge of the door panel, the following special configuration of the present invention are seen to be critical: the locations of the mountings of the inner rail 50, 52 and door rail 54, 56 posts within the hinge assembly's interior spaces and the boundary configurations and respective lengths of the hinge assembly's links that provide these links to effectively join and limit the extent to which the door panel can be opened. This situation is created by the links aligning at their further point of door panel rotation so that an outer edge 60*e* of the first link and the inner edge 62*d* of the second link interact and the SL centerline is approximately perpendicular to the FIR centerline and the outer side door member's OSM locking portion 42*f* comes to rest against the FIR locking portion 24 of each of the upper and lower inner members.

Figure 6:
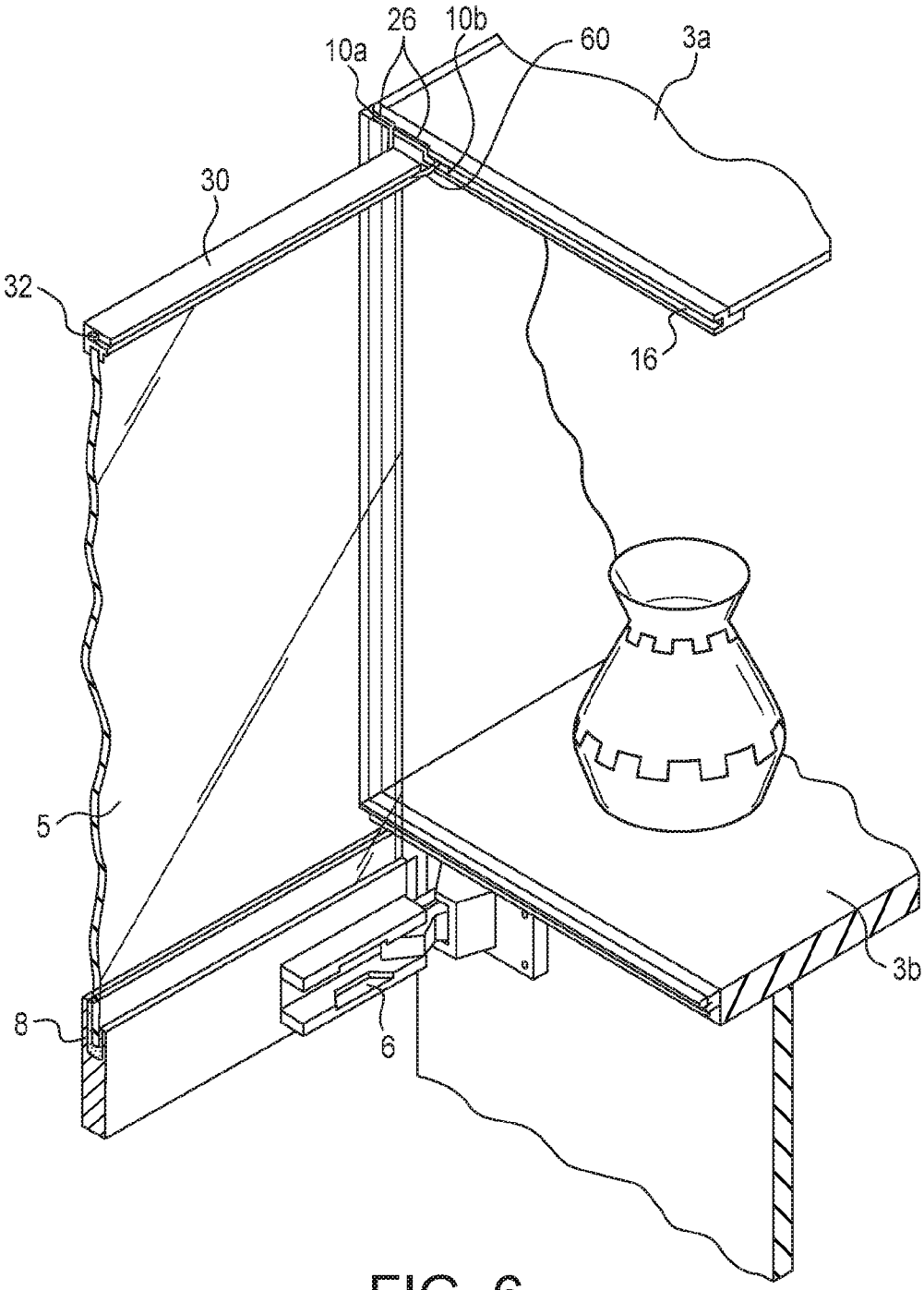
FIG. 6 is a partial, perspective view of the top and bottom corners of the display case seen in FIG. 1 after it has been upgraded by installing on the door panel's top edge the hidden, corner hinge assembly of the present invention and with the door panel in its fully open position.

FIG. 6 has been added to illustrate the present invention in use. Shown in FIG. 6 is a partial, perspective view of the top and bottom corners of the display case, with a glass top panel, seen in FIG. 1, after it has been upgraded by installing on the door panel's top edge the hidden, corner hinge assembly of the present invention and with this display case's door panel 5 in a fully open position. A Vista hinge is seen to be used on the door panel's bottom edge. In applications with glass top panel, display cases when the door is not too heavy, it may be possible to use the hinge of the present invention also on the door panel's bottom edge.

The many features and advantages of the present invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to and are considered to fall within the scope of the present invention.

I claim:

1. A hidden, corner door hinge assembly for a display case that includes a door panel, with top and bottom edges, and a display case box having top, bottom and side panels and a vertical edge to which said door panel attaches, said hidden, corner door hinge assembly comprising:

a fixed, inner rail with proximal and distal ends between which extends a fixed, inner rail centerline, and having a configuration adapted to provide a fixed, inner rail semi-enclosed, interior space with a fixed, inner rail boundary surface and a fixed, inner rail opening to the environment surrounding said display case and to allow for said fixed, inner rail to be installed proximate to said vertical edge of said display case box, a movable, door rail with proximal and distal ends between which extends a movable, door rail centerline, and having a configuration adapted provide a movable, door rail semi-enclosed, interior space with a movable, door rail boundary surface and a movable, door rail opening that is adapted to allow a significant portion of said fixed, inner rail to pass into and out of said movable, door rail opening when said door panel moves between a closed and an open position, and to allow said movable, door rail to be installed to said door panel so that a significant portion of said fixed, inner rail passes into and out of said movable, door rail opening when said door panel moves between a closed and an open position, a first fixed, inner rail post and a second fixed, inner rail post, each of which is mounted within said fixed, inner rail semi-enclosed, interior space, a first movable, door rail post, and a second movable, door rail post, each of which is mounted within said movable, door rail semi-enclosed, interior space, a first link that has proximal and distal ends and a first link centerline therebetween, and wherein the distance between said ends defines the first link length of said first link, and first link inner and first link outer edges and with said first link outer edge having a configuration that includes a notch, and wherein said proximal end is rotatably attached to said first fixed, inner rail post and said distal end is rotatably attached to said first movable door rail post, a second link that has proximal and distal ends and a second link centerline therebetween, and wherein the distance between said ends defines the second link length of said second link, and second link inner and second link outer edges, wherein said second link, proximal end is rotatably attached to said second door rail post and said second link, distal end is rotatably attached to said second inner rail post, and wherein the locations of said mountings of said rail posts within said interior spaces and the configurations of the outer edge of said first link and the inner edge of said second link and the lengths of said links are set so as to provide for the movement of said links about said fixed, inner rail posts so as to allow said door panel to open by moving inward and away from said vertical edge of said display case box until said proximal end of said second link moves into and comes into contact with said notch in said outer edge of said first link and whereby said movable, door rail and fixed, inner rail centerlines have attained a desired intersection angle.

2. The hidden, corner door hinge assembly as recited in claim 1, wherein:

said proximal end of said fixed inner rail having a cutout that is configured to allow said first and second door rail posts of said movable door rail and their attached links to move from the closed position of said door panel without said rail posts coming into contact with said boundary surface of said fixed, inner rail semi-enclosed, interior space.

3. The hidden, corner door hinge assembly as recited in claim 2, wherein:

said cutout of said proximal end of said fixed inner rail having a fixed, inner rail locking portion, said proximal end of said movable door rail having an inner member locking portion that is configured to come into contact with said fixed, inner rail locking portion when said desired intersection angle is approximately 90 degrees.

4. The hidden, corner door hinge assembly as recited in claim 3, wherein:

said movable, door rail configuration further adapted to provide an enclosing member that encloses said top edge of said door panel so as to lock said door panel into said movable door rail.

5. The hidden, corner door hinge assembly as recited in claim 4, wherein:

said fixed, inner rail configuration further adapted to provide a partial support for the top panel of said display case box.

6. The hidden, corner door hinge assembly as recited in claim 3, wherein:

said fixed, inner rail configuration further adapted to provide a partial support for the top panel of said display case box.

7. The hidden, corner door hinge assembly as recited in claim 2, wherein:

said movable, door rail configuration further adapted to provide an enclosing member that encloses said top edge of said door panel so as to lock said door panel into said movable door rail.

8. The hidden, corner door hinge assembly as recited in claim 7, wherein:

said fixed, inner rail configuration further adapted to provide a partial support for the top panel of said display case box.

9. The hidden, corner door hinge assembly as recited in claim 2, wherein:

said fixed, inner rail configuration further adapted to provide a partial support for the top panel of said display case box.

10. The hidden, corner door hinge assembly as recited in claim 1, wherein:

said movable, door rail configuration further adapted to provide an enclosing member that encloses said top edge of said door panel so as to lock said door panel into said movable door rail.

11. The hidden, corner door hinge assembly as recited in claim 10, wherein:

said fixed, inner rail configuration further adapted to provide a partial support for the top panel of said display case box.

12. The hidden, corner door hinge assembly as recited in claim 1, wherein:

said fixed, inner rail configuration further adapted to provide a partial support for the top panel of said display case box.

* * * * *